US006275196B1

(12) United States Patent
Bobier

(10) Patent No.: US 6,275,196 B1
(45) Date of Patent: Aug. 14, 2001

(54) PARABOLIC HORN ANTENNA FOR WIRELESS HIGH-SPEED INTERNET ACCESS

(75) Inventor: Joseph Bobier, Sarasota, FL (US)

(73) Assignee: iDigi Technologies, Inc., Sarasota, FL (US)

( * ) Notice: Subject to any disclaimer, the term of this patent is extended or adjusted under 35 U.S.C. 154(b) by 0 days.

(21) Appl. No.: 09/730,222

(22) Filed: Dec. 5, 2000

Related U.S. Application Data

(60) Provisional application No. 60/203,790, filed on May 12, 2000.

(51) Int. Cl.[7] ..... H01Q 19/12

(52) U.S. Cl. ..... 343/840; 343/772; 343/780; 343/786

(58) Field of Search ..... 343/772, 775, 343/779, 786, 780, 837, 840, 912; H01Q 13/02, 19/12, 19/13

(56) References Cited

U.S. PATENT DOCUMENTS 3,646,565 * 2/1972 Robinson et al. ..... 343/781
4,297,710 * 10/1981 Dupressoir ..... 343/756
4,423,422 * 12/1983 Knop et al. ..... 343/786
4,477,816 * 10/1984 Cho ..... 343/786
4,607,260 * 8/1986 Dragone ..... 343/786
4,698,641 * 10/1987 Evans et al. ..... 343/882
5,995,057 * 11/1999 Faith et al. ..... 343/781 R

* cited by examiner

*Primary Examiner*—Tho Phan
(74) *Attorney, Agent, or Firm*—Dennis L. Cook; Fowler, White, Gillen, Boggs, Villareal and Banker, P.A.

(57) ABSTRACT

A parabolic horn antenna designed for use as a high isolation antenna array in a wireless Internet access system where a high concentration of transceivers at one location is required. The rear, reflecting surface of the horn part of the antenna is a parabolic shape with the probe located at the focal point of the parabola. The sides of the antenna in the broad dimension are angled at an optimum degree increasing the opening aperture allowing the system to capture more RF energy. The length, therefore the aperture width is variable providing control over the gain of the system thus providing effective shielding and isolation for more dense antenna arrays.

7 Claims, 3 Drawing Sheets

PARABOLIC HORN ANTENNA FOR WIRELESS HIGH-SPEED INTERNET ACCESS

CROSS-REFERENCE TO RELATED APPLICATION

The present application claims the benefit of previously filed co-pending Provisional Patent Application, Serial No. 60/203,790 filed May 12, 2000.

FIELD OF THE INVENTION

This invention relates, generally, to an improvement in radio system construction and deployment that allows for a higher concentration of radio transceivers to be co-located and more specifically to a parabolic horn antenna designed for use as a high isolation antenna array in a wireless Internet access system where a high concentration of transceivers at one location is required.

BACKGROUND OF THE INVENTION

As the communications industry continues to evolve, ever-increasing demand for high-speed broadband solutions for communications will result, with the accompanying technologies experiencing a similar demand pattern. While industry analysts predict that 100-megabit speeds will be common by the year 2002, the disclosed antenna design can assist in delivering these speeds now.

The need for high-speed Internet access within the U.S. is well defined. With respect to Internet applications alone, as of December 1999, there were fewer than 250,000 U.S. customers purchasing DSL services, as compared to more than 30 million Internet customers. Beyond Internet applications, this novel antenna has a number of other uses for its special capabilities, including video, telephony and all forms of telephony, including mobile communications. This unique antenna design helps eliminates high infrastructure investment in constructing costly base stations, laying cable, or deploying satellites for high-speed Internet access by allowing more transceivers to be co-located on one tower.

This invention discloses a particular antenna design, which is referred to as a parabolic horn antenna. This antenna combines the familiar horn antenna, also known as a wave guide antenna, and the parabolic dish antenna The result is superior efficiency in terms of gathering captured radio energy and delivering that energy to the coaxial cable delivery system thus improving the speed of Internet access. When placed in an array it creates a high isolation antenna array useful when co-locating large numbers of transceivers at one location.

Just as radio equipment that is situated very close together can leak RF energy causing destructive interference, so can the antenna. Antennas are made to radiate energy as well as to collect the same sort of energy. Therefore it becomes very important, yet difficult, to isolate antennas so that when connected to multiple uncoordinated transmitters in close proximity the antennas will not interfere with each other. This is generally accomplished by two methods, the first is vectoring and the second is shielding. Vectoring is simply directing the RF energy that the antenna radiates into a desired direction. For high-speed wireless Internet access the need exists to direct the energy so efficiently that virtually no energy leaks to the antenna of another radio where it would be received by another nearby receiver. In essence, for this application, the antennas need to behave like very focused spotlights. In situations where few antennas are used, physical spacing between the antennas of 5 or more feet is possible, and, with the antennas directed into opposite directions, it is usually effective to simply use prior art directional antennas like the Breezecom model Uni-13, or similar models well known to those skilled in the art. Where the antenna density is higher, the design of this parabolic horn antenna delivers excellent isolation from other nearby antennas, even closely spaced and in the same relative vector.

The familiar horn antenna provides a means of coupling RF energy from a coaxial cable connection to free space by means of a radiator that is situated within the horn assembly. Reference the ("American Radio Relay League") Antenna Handbook, page 18–14, FIG. 19. The horn serves as an impedance matching device. The relative spacing of the radiator to the rear, inside surface will determine the impedance of the radiator, thus matching to the common 50-ohm coaxial RF cable. No attempt is generally made to focus the RF energy other than by the general dimensions of the horn that are calculated to fall within the guidelines of general wave guide design. Reference the ARRL Antenna Handbook, page 18–3, Wave Guide Dimensions, 1997–1998 American Radio Relay League.

The dimensions for typical wave guide antennas are determined by:

1. Cross sectional dimension, radius (r) being approximately ½ wavelength (wl) of frequency of operation (Fo) in a circular design when the device is operating in the Transverse Magnetic Mode (tm).
2. Longest wavelength transmitted with little attenuation will be 3.2 r.
3. Cutoff wl is 3.41 r.
4. Shortest wl before next mode of operation (TE mode) becomes possible is 2.8 r.
5. Spacing of radiator to rear wall is ¼ wavelength/guide (wlg)

This invention acknowledges the effectiveness of the wave guide antenna, then improve upon it by adding additional geometry that focuses the RF energy upon the radiating element, thus increasing the energy incident upon the active element.

The parabolic shape of the closed end of the antenna focuses all of the captured RF energy onto the active radiator. This represents an improvement over traditional wave guide antennas with flat, closed ends. The prior art antennas reflect any uncaptured RF energy back out of the front of the antenna resulting in lost signal.

Horn antennas configured with reflectors are known in the prior art, but none with the configuration disclosed by this invention. For example U.S. Pat. No. 4,607,260 issued to Dragone on Aug. 19, 1986, titled Asymmetrically Configured Horn Antenna discloses a horn antenna which provides minimized cross-polarization in the far field of the antenna. The antenna arrangement comprises a horn including four walls wherein a first pair of opposing concentric conic walls are associated with a common longitudinal axis, and a second pair of opposing planar walls are aligned radially to the common longitudinal axis of the cones. The walls taper down from an offset parabolic main reflector to intersect a common apex corresponding to a focal point of the main reflector. The longitudinal axis of the horn is arranged at a predetermined angle to the common longitudinal axis of the cones to minimize cross-polarization in either one or both of the TE.sub.01 or TE.sub.10 modes in the far field of the antenna.

U.S. Pat. No. 2,817,837 issued to G. V. Dale et al on Dec. 24, 1957 discloses a large horn reflector described as a "sectorial bi-conical horn". There, the horn includes outwardly-concave, conically-shaped, front and rear surfaces and flat side surfaces. The horn arrangement is allegedly designed to provide improved impedance versus frequency characteristics along with substantially no tendency to become distorted by temperature changes.

Other horn antenna arrangements have been designed using a conical horn section as disclosed, for example, in U.S. Pat. No. 3,510,873 issued to S. Trevisan on May 5, 1970; U.S. Pat. No. 3,646,565 issued to G. P. Robinson, Jr. et al on Feb. 29, 1972; and U.S. Pat. No. 3,936,837 issued to H. P. Coleman on Feb. 3, 1976.

It is therefore clear that a primary object of this invention is to advance the art of antenna design. A more specific object is to advance said art by providing an improved efficiency antenna useful for high-speed wireless Internet access. It is a further object of this invention to provide an antenna with improved shielding and isolation that delivers improved isolation from other nearby antennas, even closely spaced and in the same relative vector.

These and other important objects, features, and advantages of the invention will become apparent as this description proceeds. The invention accordingly comprises the features of construction, combination of elements and arrangement of parts that will be exemplified in the construction hereinafter set forth, and the scope of the invention will be indicated in the claims.

SUMMARY OF THE INVENTION

A parabolic horn antenna designed for use as a high isolation antenna array in a wireless Internet access system where a high concentration of transceivers at one location is required. The rear, reflecting surface of the horn part of the antenna is a parabolic shape with the probe located at the focal point of the parabola. The sides of the antenna in the broad dimension are adjustable so they can be angled to an optimum degree thereby increasing the opening aperture allowing the system to capture more RF energy. The length, therefore the aperture width is variable providing control over the gain of the system thus providing effective shielding and isolation for more dense antenna arrays.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

The antenna for any RF system serves to radiate and intercept the radio signal. It is the connection to the world for any radio transmitter and/or receiver. In many cases, the antenna is designed to radiate or intercept RF energy from specific directions. Usually, this is done in order to improve the RF link performance from one antenna to another. This concentration of signal in a specific direction results in "gain" or an apparent increase of transmitter power or receiver sensitivity. This of course comes at a cost. Signal in other directions (vectors) will diminish. When attempting to locate several transmitters at one location, this is a desirable side effect.

Figure 4:
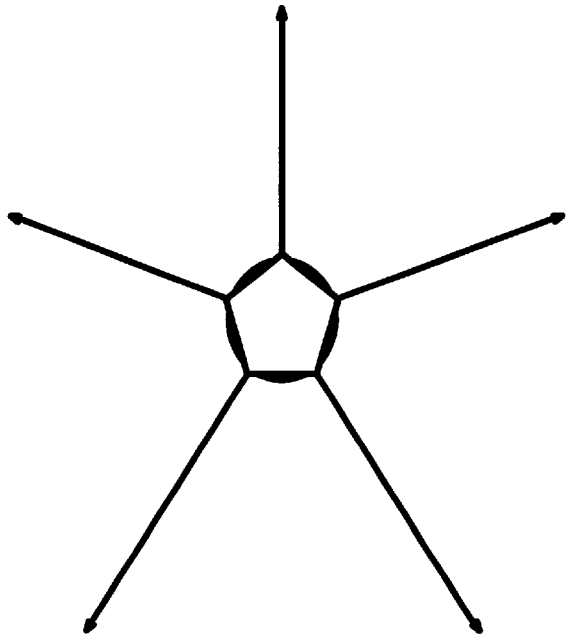
FIG. 4 is the first diagram showing a wireless cell layout.

In the depicted cell of FIG. 4, there are 5 directions or vectors, which the antennas are directed towards. For 360-degree coverage then, each antenna should have a 72-degree beam width. The parabolic horn antenna of this invention is adjustable, thus allowing adjustment of the beam width to exactly 72 degrees. Any number of vectors could be used in a given antenna array, as could any number of arrays, spaced vertically on a given tower. Practical limits dictate about 12 vectors per tier.

The preferred embodiment of this disclosure shows this novel antenna in a wireless Internet access system where radio frequencies in the 2.4 GHz band are used. By virtue of the characteristics of this band the signal is considered to be "line of site", with little penetration capability. In addition, the signal strength is limited to an ERP of 4 Watts so it is most important to put the signal where the users are.

Another design aspect of an effective high-speed wireless Internet access system is use of a Spread Spectrum Frequency Hopping radio system. (SSFH). In this system, the radio changes frequency up to several times per second in a pseudo random fashion comprising up to 79 available radio channels. Each cell vector, consisting generally of one antenna, uses one single radio or base station. When several base stations (AP's) are co-located and each is "hopping" in its own random pattern, one can imagine occasions upon which two radios would happen to use the same frequency at the same time. As more and more base stations are added to the same cell, the statistical probability of the same frequencies at the same time increases and frequency collisions create a point of diminishing returns, that is where adding more radios will add little system throughput or may actually diminish system throughput. This effect is shown more clearly in FIG. 5. In actual installations, the point of negative benefit is at the $15^{th}$ radio to be co-located. The parabolic horn antenna of this invention reduces the RF collisions by isolating the radio signals from one another.

Figure 1:
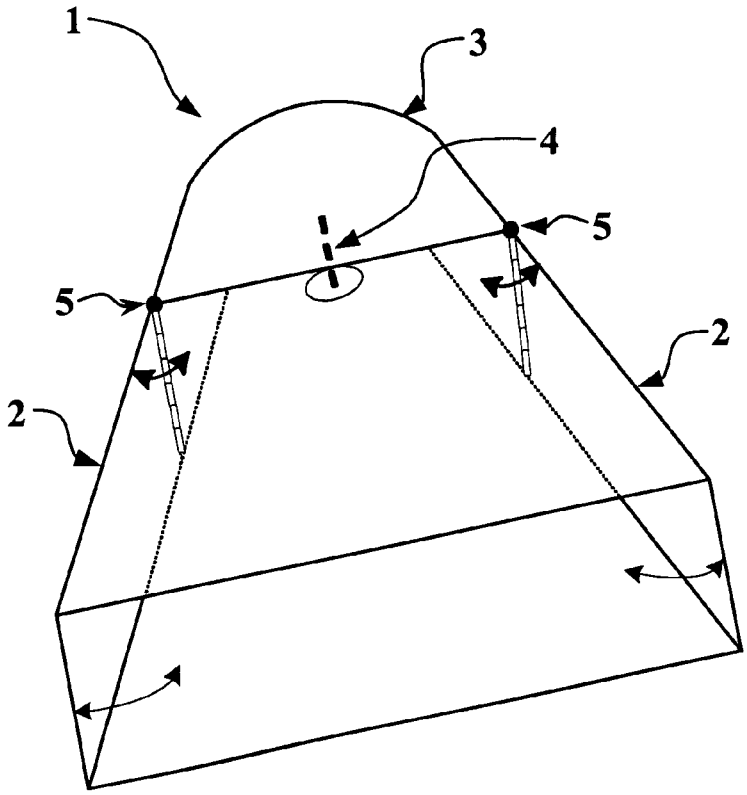
FIG. 1 is a partial cut away perspective view of the parabolic feed horn antenna for use in the 2.4 GHz band.

The parabolic horn antenna of this preferred embodiment is disclosed in more detail in FIG. 1. This parabolic horn antenna (1) has an exceptional shielding effect at the side walls (2) and rear reflecting portion (3) of the antenna, which tends to isolate one vector from to another. The high degree of shielding is due to three factors.

1. The parabolic horn antenna (1) is made of solid mild steel, with no grid work or other holes.
2. The physical dimensions of the parabolic horn antenna (1) form a resonant cavity.
3. The rear reflecting portion (3) is shaped in a parabolic form, thus effecting maximum efficiency when directing signal either into the probe (4) or directing energy out the front.

Figure 5:
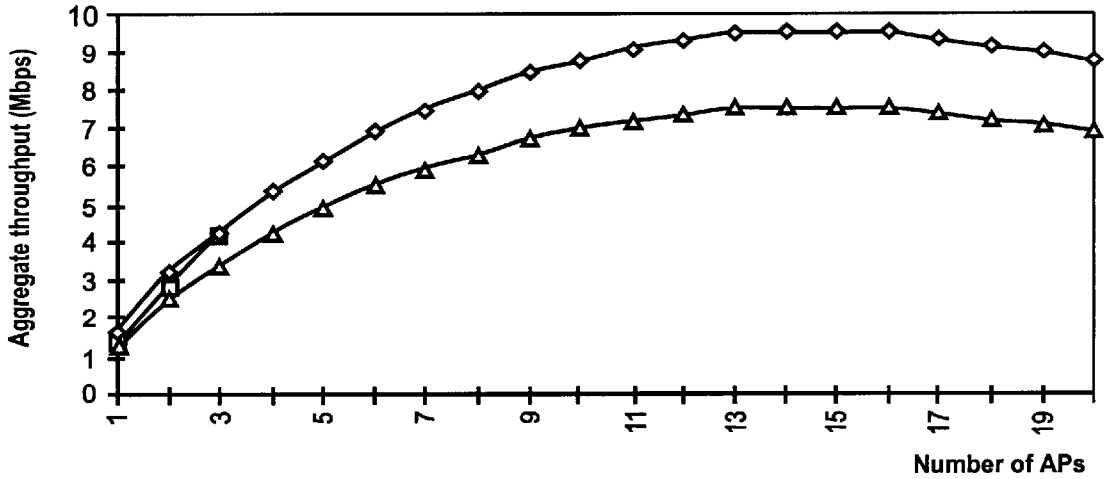
FIG. 5 is the second diagram showing aggregate throughput of co-located systems.

Once the vectors are isolated, the number of co-located radios may be increased beyond the prior art limit of 15 as shown in FIG. 5.

Referring to the mechanical diagram, FIG. 1, the parabolic horn antenna (1) is designed using many formulae similar to those used when designing a wave guide antenna. The notable differences are that the rear reflecting portion (3) of the parabolic horn antenna (1) is a true parabolic shape with the probe (4) located at the focal point of the parabola. Also, the side walls (2) of the parabolic horn antenna (1), in the broadest dimension, are adjustable by hinges (5) so they can be angled at an optimum degree, which increases the opening aperture allowing the system to capture more RF energy than a simple rectangular or tubular wave guide antenna would allow. The length, therefore the aperture width is variable, thus providing control over the aperture size and therefore gain of the system. Finally, the radiation pattern is wider in the horizontal angle than the vertical angle, providing a more beneficial pattern when broadcasting from a high position such as a tall tower; for example broadcasting to a community on the ground from a high elevation while preventing signal from being wasted in a skyward vector.

The angled side walls (2) are designed for optimal performance. If the angle is too narrow, the effective aperture area is reduced, resulting in lost capture opportunity. If the angle is too wide, velocity factors along the metal surface of the side walls (2) cause a delay in signal propagation relative to the more direct signal path near the center of the aperture. Thus, if the angle is too wide, signal cancellation will occur between the two signals causing an electrical nulling of the energy. Although these side walls (2) can be fixed when it is known ahead of time what the optimal effective aperture area will be, in the preferred embodiment the angled side walls (2) are connected to the rear reflecting portion (3) of the parabolic horn antenna (1) by a hinge (5) making for easy adjustment of the effective aperture area.

Side and rear rejection of signal (front to back ratio) is on the order of 30–40 DB isolation, depending on the metal used. It has been determined that mild steel construction is greatly favorable over aluminum or magnesium construction because of it's lower permeability to RF energy. This would be critical in installations where several radio devices will be co-located, and operating on potentially interfering frequencies, such as SSFH radio systems operating in an uncoordinated fashion as is required in the unlicensed ISM radio spectrum.

Energy may be introduced or extracted from the antenna by either the electric or the magnetic field. The energy transfer frequently used is through a coaxial line. Two methods of coupling to wave guides are thus commonly used. These are loop and probe methods. The seldom used loop method involves the extension of the coaxial cable center conductor into the cavity, then looping it 180 degrees and attaching the free end to the cavity wall. This creates an interface similar to the shorted stub matching system well known to those skilled in the art and used in many antenna designs.

The probe method, more commonly used, is comprised of either a straight or bent center conductor extension, inserted into the cavity. The free end is not connected to the cavity wall. In such a case, the probe is generally ¼ wl long. If a bent probe is used, it may be rotated to adjust the degree of coupling. Coupling is maximum when the probe is cross-sectional to the magnetic lines of force. Coupling is minimum when the probe is parallel to the lines of force.

In the preferred embodiment of this invention, the probe (4) is typically formed of a straight section of metal tubing; copper, brass, silver or other conductive material may be used. The probe (4) is mounted at the focal point of the parabolic rear reflecting portion (3), at a distance of ¼ wgl (wave guide length) from the surface of the rear reflecting portion (3). Within the parabolic horn antenna (1), radio energy will decelerate to some velocity lower than the free-space speed of light. The factor of deceleration will vary, depending on the RF wavelength relative to the vertical antenna dimension and the conductivity of the material used. Generally, the deceleration factor will be about 10%, however it can vary by even more, up to 30%. In the preferred embodiment a 10% velocity factor is typical. The velocity factor will therefore affect the distance spacing of the probe (4) relative to the rear reflecting portion (3). The adjusted distance or wavelength is referred to as the wave guide length (wgl). Wgl may be calculated as wl times velocity factor. In the preferred embodiment the wgl is typically 1.1 wl.

Figure 2:
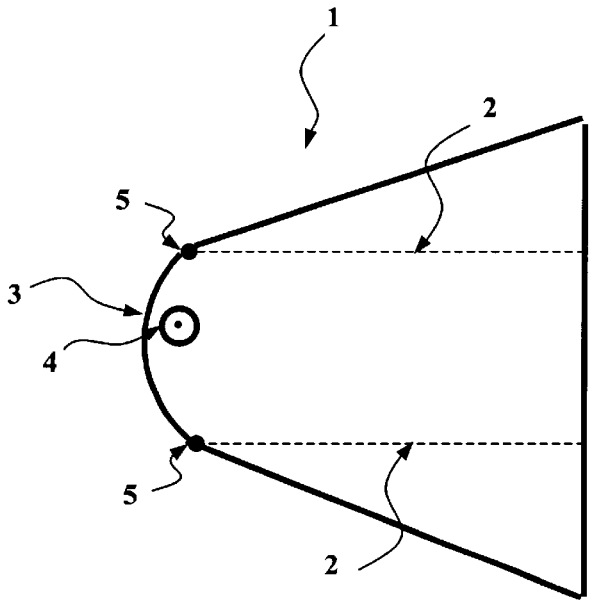
FIG. 2 is a bottom mechanical view of the parabolic feed horn antenna showing location of the radiator and adjustable sides.
Figure 3:
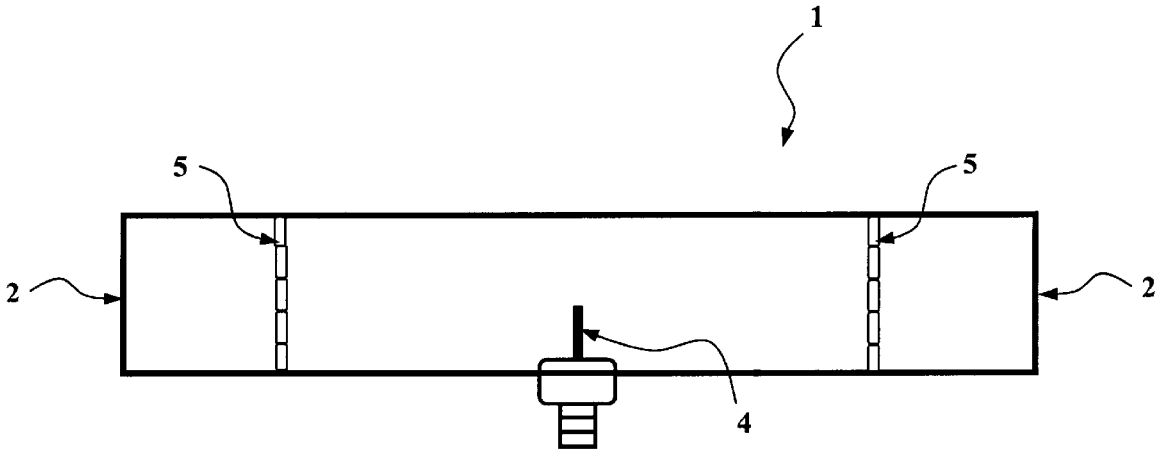
FIG. 3 is a front mechanical view of the parabolic feed horn antenna.

In the preferred embodiment the parabolic horn antenna (1) is designed for the 2.4 GHz band. This means a wavelength (wl) of 1.2 inches and a wave guide length of 1.32 inches. The length of the parabolic horn antenna (1) of the preferred embodiment is 15 inches from the back of the closed end (3) to the aperture opening. The width at the hinge points (5) is 6.5 inches. The height of the antenna (1) is 0.75 wl or equal to 0.9 inches. As mentioned earlier, the sides (2) are adjustable by a hinge (5) and allow for adjustment of the aperture opening from 8 inches to 15 inches. Looking to FIG. 2 the probe (4) is located ¼ wgl from the closed end (3) or 0.33 inches. FIG. 3 shows the probe (4) extending up into the antenna (1). In the preferred embodiment the probe (4) extends ¼ wl or 0.3 inches. In the configuration of the preferred embodiment gain of 13 to 19 dbi is accomplished with a front to back ratio of the antenna (1) measuring 30 db.

Many modifications and other embodiments of the invention will come to the mind of one skilled in the art having the benefit of the teachings presented in the foregoing descriptions and the associated drawings. Therefore, it is to be understood that the invention is not to be limited to the specific embodiments disclosed, and that modifications and embodiments are intended to be included within the scope of the dependent claims.

What is claimed is:

1. A parabolic reflector horn antenna arrangement for bi-directionally directing a wavefront between the far field of the antenna and the focal point of the parabolic reflector horn antenna comprising:

a rear reflector section;

said rear reflector section comprising a rectangularly shaped reflective material;

said rear reflector section having a longer horizontal dimension than vertical dimension;

said rear reflector section having an upper edge, a lower edge, a side edge, and an opposite side edge;

said rear reflector section being curved in the horizontal direction in a parabolic curve around a focal point in such manner that said upper edge and said lower edge each form a parabola and said side edge and said opposite side edge remain straight;

said parabolic curve being determined such that said focal point will be located at a distance from the surface of said rear reflector section of ¼ wave guide length where wave guide length is determined by multiplying the wavelength said parabolic reflector horn antenna is designed to operate at by the Velocity Factor of said parabolic reflector horn antenna;

said parabolic reflector horn antenna including a top reflector wall section comprising a flat triangularly shaped reflective material;

said top reflector wall section having one pointed corner replaced with a parabolic shape matching said upper edge of said rear reflector section;

said parabolic shaped corner of said top reflector wall section being connected to said upper edge of said rear reflector section such that said top reflector wall section extends horizontally planer and extends radially outward beyond said predetermined focal point;

said parabolic reflector horn antenna including a bottom reflector wall section comprising a flat triangularly shaped reflective material;

said bottom reflector wall section having one pointed corner replaced with a parabolic shape matching said lower edge of said rear reflector section;

said parabolic shaped comer of said bottom reflector wall section being connected to said lower edge of said rear reflector section such that said bottom reflector wall section extends horizontally planer and extends radially outward beyond said predetermined focal point;

said parabolic reflector born antenna including a side reflector wall section comprising a rectangularly shaped reflective material;

said side reflector wall section having a height equal to the length of said side edge of said rear reflector section and having a length equal to the length of either of the two edges of said top reflector wall section that extent radially outward from said rear reflector section;

said side reflector wall section having one of the two edges that are equal in length to said side edge of said rear reflector section being connected to said side edge of said rear reflector section such that said side reflector wall section's upper edge abuts said top reflector wall section and said side reflector wall section's lower edge abuts said bottom reflector wall section and extending radially outward at an angle chosen to maximize the effective aperture area of said parabolic reflector horn antenna and minimize signal cancellation;

said parabolic reflector horn antenna including an opposite side reflector wall section comprising a rectangularly shaped reflective material;

said opposite side reflector wall section having a height equal to the length of said opposite side edge of said rear reflector section and having a length equal to the length of the either of the two edges of said top reflector wall section that extent radially outward from said rear reflector section;

said opposite side reflector wall section having one of the two edges that are equal in length to said opposite side edge of said rear reflector section being connected to said opposite side edge of said rear reflector section such that said opposite side reflector wall section's upper edge abuts said top reflector wall section and said opposite side reflector wall section's lower edge abuts said bottom reflector wall section and extending radially outward at an angle chosen to maximize the effective aperture area of said parabolic reflector horn antenna and nnnimize signal cancellation;

a radiator;

said radiator located at said focal point of said rear reflector section;

said radiator capable of inputting electromagnetic energy into said parabolic reflector horn antenna; and, said radiator capable of detecting electromagnetic energy captured in said parabolic reflector horn antenna.

2. An antenna arrangement according to claim 1 wherein said reflective material is stainless steel.

3. An antenna arrangement according to claim 1 wherein said radiator is constructed of a straight section of tubing made of conductive material.

4. An antenna arrangement according to claim 3 wherein said tubing is a metal such as copper, brass, or silver.

5. An antenna arrangement according to claim 1 further comprising:

a hinge, said side reflector wall section having one of the two edges that are equal in length to said side edge of said rear reflector section being connected by said hinge to said side edge of said rear reflector section such that said side reflector wall section's upper edge abuts said top reflector wall section and said side reflector wall section's lower edge abuts said bottom reflector wall section and can be rotated around said hinge connection to adjust the effective aperture area of said parabolic reflector horn antenna; and, said opposite side reflector wall section having one of the two edges that are equal in length to said opposite side edge of said rear reflector section being connected by said hinge to said opposite side edge of said rear reflector section such that said opposite side reflector wall section's upper edge abuts said top reflector wall section and said opposite side reflector wall section's lower edge abuts said bottom reflector wall section and can be rotated around said hinge connection to adjust the effective aperture area of said parabolic reflector horn antenna.

6. An antenna arrangement according to claim 1 wherein said radiator is constructed of a bent section of tubing made of conductive material.

7. An antenna arrangement according to claim 6 wherein said tubing is a metal such as copper, brass, or silver.

* * * * *